US005695000A

United States Patent [19]

Uzaki et al.

[11] Patent Number: 5,695,000

[45] Date of Patent: Dec. 9, 1997

[54] APPARATUS FOR PRODUCING MOLDS

[75] Inventors: Nagato Uzaki, Toyohashi; Ukichi Oishi, Toyokawa; Ryoji Kanayama, Toyohashi; Hironobu Amano; Tokiya Terabe, both of Toyokawa, all of Japan

[73] Assignee: Sintokogio, Ltd., Japan

[21] Appl. No.: 569,726

[22] Filed: Dec. 8, 1995

[30] Foreign Application Priority Data

Dec. 9, 1994 [JP] Japan ..... 6-331483

[51] Int. Cl.[6] ..... B22C 15/28

[52] U.S. Cl. ..... 164/194; 164/169; 164/195

[58] Field of Search ..... 164/169, 194, 164/195, 207, 37, 38

[56] References Cited

U.S. PATENT DOCUMENTS

| | | | |
|---|---|---|---|
| 4,230,172 | 10/1980 | Uzaki et al. | 164/195 X |
| 5,148,852 | 9/1992 | Oishi | 164/169 |
| 5,476,136 | 12/1995 | Leutwiler et al. | 164/169 X |

FOREIGN PATENT DOCUMENTS

| | | | |
|---|---|---|---|
| 1192790 | 5/1965 | Germany | 164/194 |
| 3238712 | 4/1984 | Germany | 164/195 |
| 3939001 | 1/1991 | Germany | 164/169 |
| 58-107251 | 6/1983 | Japan | 164/37 |
| 60-6246 | 1/1985 | Japan . | |
| 3-204138 | 9/1991 | Japan | 164/37 |
| 6-15410 | 1/1994 | Japan | 164/169 |

*Primary Examiner*—J. Reed Batten, Jr.
*Attorney, Agent, or Firm*—Limbach & Limbach L.L.P.

[57] ABSTRACT

The molding apparatus includes a table movable between an area where molding sand is fed and a mold-producing area for carrying a pattern plate on which a flask is mounted, a cylinder for vertically moving the table, a closing cover having an opening at the lower part thereof, the opening communicating with an upper opening of the flask. The closing cover has a stepped part such that the cross-sectional area of the lower part of the closing cover is smaller than that of the upper part thereof. At least one air-supply pipe communicates with the upper part of the closing cover and an air valve communicates with the air-supply pipe to introduce ambient air into the air-supply pipe. An opening is formed in an upper and side part of the closing cover for communicating with a vacuum source. A press plate is suspended in the closing cover for a vertical movement such that the press plate can be airtightly inserted into the small lower part of the closing cover.

5 Claims, 6 Drawing Sheets

APPARATUS FOR PRODUCING MOLDS

DETAILED DESCRIPTION OF THE INVENTION

1. Field of the Invention

This invention relates to an apparatus for producing a mold by pressing molding sand fed into a mold-producing area defined by a pattern plate, which has a pattern thereon, and a molding flask mounted on the pattern plate.

2. Description of the Prior Art

Conventionally, several methods for producing molds have been developed, wherein molding sand fed into a mold-producing space defined by a pattern plate and a flask is pressed by a press plate. For example, Japanese Patent Laying-Open (KOKAI) No. 60-6246 teaches a method for pressing molding sand wherein a press plate is disposed and temporarily fixed just above a flask filled with molding sand, air is applied under high pressure to the top of the press plate until the pressure reaches a predetermined value, and the fixed press plate is then released, thereby rapidly lowering the press plate to press the molding sand.

However, a mold-producing apparatus which carries out this method requires a clamping force of several tens of tons to fix the flask and pattern plate since the air is applied under high pressure. Thus the apparatus must have great rigidity and strength and therefore be heavy-duty. This is a disadvantage.

This invention is made to overcome this disadvantage. It aims to provide an apparatus with less rigidity and less strength for pressing molding sand.

SUMMARY OF THE INVENTION

To achieve the purpose of the invention the apparatus includes a table movable between an area where molding sand is fed and a mold-producing area for carrying a pattern plate on which a flask is mounted, a cylinder for vertically moving the table, a closing cover having an opening at the lower part thereof, the opening communicating with an upper opening of the flask, the closing cover having a stepped part such that the cross-sectional area of a lower part of the closing cover is smaller than that of an upper part thereof, at least one air-supply pipe to communicate with an upper part of the closing cover, an air valve to communicate with the air-supply pipe to introduce ambient air into the air-supply pipe, an opening formed in an upper and side part of the closing cover to communicate with a vacuum source, and a press plate suspended in the closing cover for a vertical movement such that the press plate can be airtightly inserted into the small lower part of the closing cover.

In the invention designed as mentioned above, since molding sand is compressed first mechanically by using the difference in the pressure between the ambient pressure and the vacuum, the apparatus does not require high pressure and can be of lower mechanical rigidity and strength.

DESCRIPTION OF THE PREFERRED EMBODIMENTS

Figure 1:
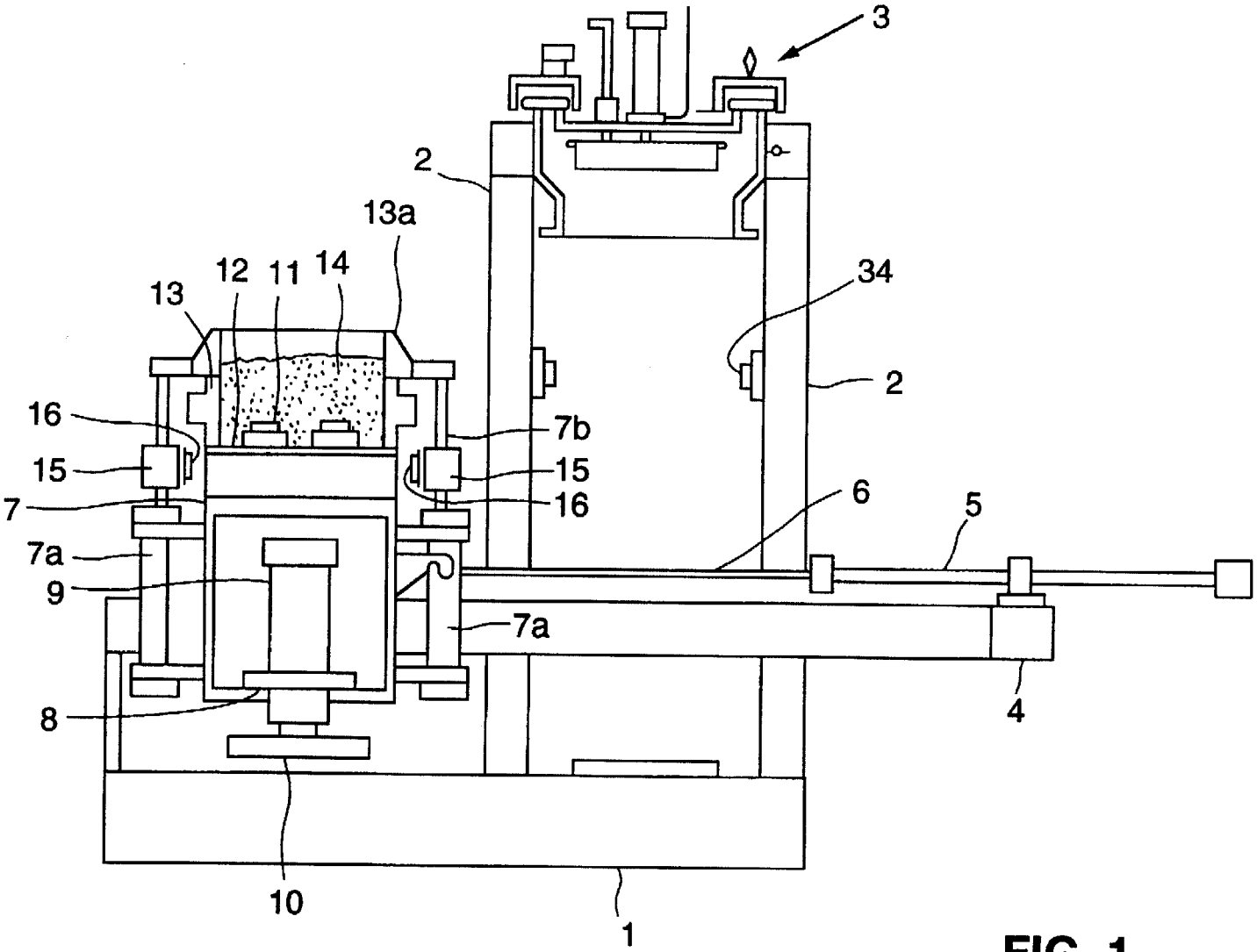
FIG. 1 is a partially cross-sectional schematic view of an embodiment of the apparatus of the invention after molding sand has been fed to it.

The embodiments of the invention will now be explained in detail by referring to the accompanying drawings. In FIG. 1 a plurality of columns 2, 2 are mounted on a base 1. An air-flow head and press plate assembly 3 is fixedly mounted on the tops of the columns 2, 2. Further, a pair of guide rails 4, 4, which extend horizontally (in the drawing only one rail, extending from the left to right, is seen) are mounted on the columns at the part intermediate of the tops of the columns 2, 2 and the base 1. A cylinder 5 is mounted on the guide rails with one of its ends being secured to the guide rails to be supported by it. The cylinder 5 has a cylinder rod 6 at the other end. The cylinder rod 6 is connected to a table 7 such that it can be disconnected from the table. The table 7 has a cavity. A cylinder 9, which acts as means to vertically move the table, is mounted on a bottom plate 8 of the table 7 such that it extends into the cavity of the table 7. A plate 10 is fixedly mounted on the rod of the cylinder 9, which is directed downward. A pattern plate 12 having a pattern 11 thereon is placed on the top of the table 7, and a molding flask 13 and a filling frame **13*a* are placed on the pattern plate 12. The pattern plate 12, molding flask 13, and filling frame 13*a* define a mold-producing area into which molding sand is fed. A pair of guide rails 15, 15, which are raised by a plurality of cylinders 7*a*, 7*a*, and a pair of guide rollers 16, 16, are disposed outside the molding flask 13. The guide rails 15, 15 are connected to the filling frame 13*a* via a connecting member 7*b***.

Figure 2:
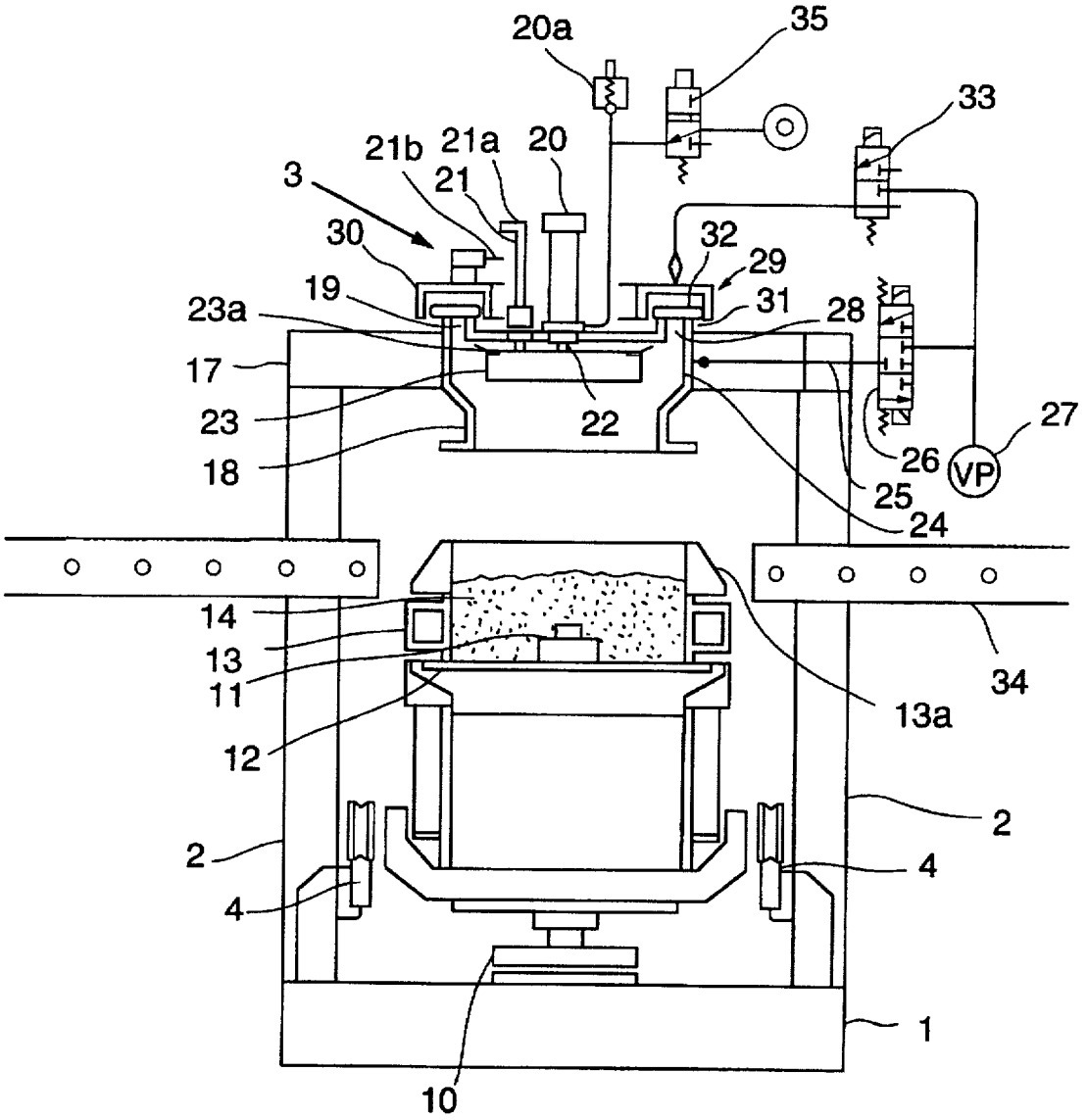
FIG. 2 is a partially cross-sectional schematic view of the embodiment wherein its closed space is not yet formed.

In FIG. 2, which is a view from the side of the apparatus of FIG. 1, a head plate 17 is secured to the tops of the columns 2, 2. A closing cover 18 is fixedly mounted on the head plate 17. The closing cover 18 at its lower end has an opening which corresponds to the upper opening of the molding flask 13 or filling frame **13*a***. The closing cover also has a stepped part such that the cross-sectional area of its upper part is larger than that of the lower part.

Further, a cylinder 20, which is directed downward, and a guide pin 21, are mounted on the central part of the ceiling 19 of the closing cover 18. A press plate 23 is secured to both the lower end of the piston rod 22 of the, cylinder 20 and the lower end of the guide pin 21 such that the press plate 23, which is provided with a seal member **23*a* at a circumferential part thereof, can be airtightly inserted into the small lower part of the closing cover 18 to move vertically. To ensure that the press plate 23 can move rapidly downwards a safety valve 20*a* is attached to the cylinder 20, while an opposed limit switch lever 21*a* and limit switch 21*b* are attached to the guide pin 21 to detect the vertical location of the guide pin 21**.

Figure 5:
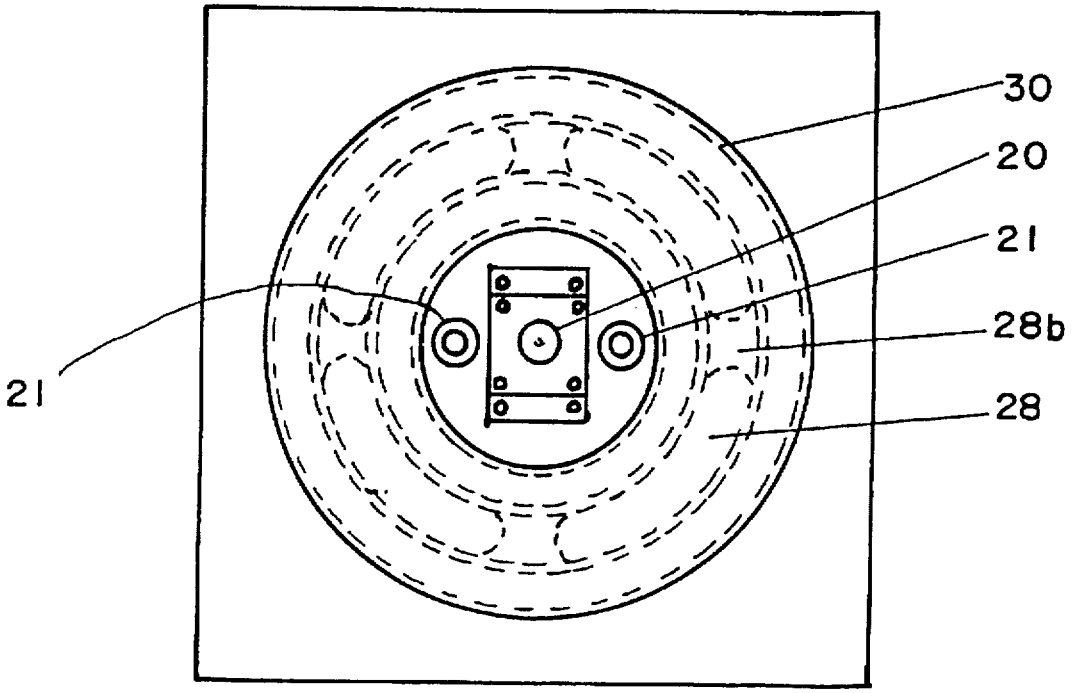
FIG. 5 is a schematic plan view of an air-supply pipe and an air valve used in the embodiment.
Figure 6:
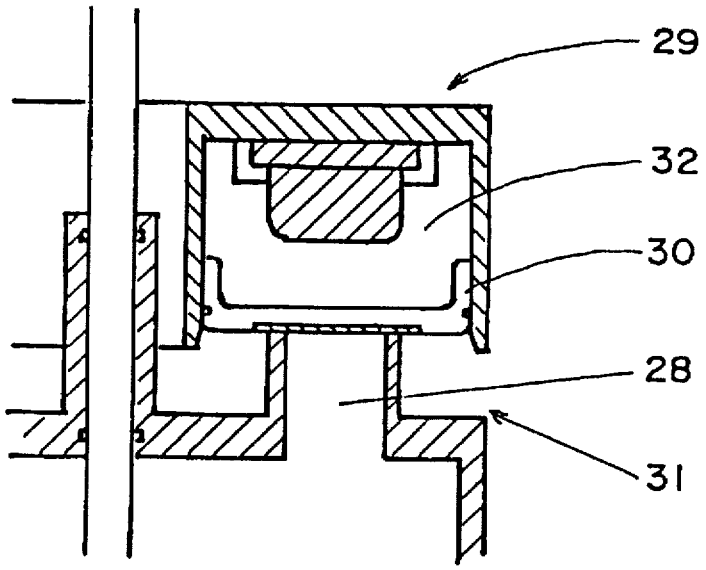
FIG. 6 is a schematic and enlarged sectional view of the air-supply pipe and air valve of FIG. 5.

Further, one, or more than one, of an air-supply pipe 28 is disposed in an annular bore **28*b* (see FIG. 5), and an annular air valve 29 is disposed above the air-supply pipe 28. As is clear in FIGS. 5 and 6, the air valve 29 includes a piston 30, which is slidable on the inner wall surfaces of the valve 29, and which opens the pipe 28 to communicate with the outside ambient air via a lower space 31 of the piston 30**.

The upper space 32 of the piston 30 communicates with a vacuum source 27 through an electromagnetic valve 33. Further, a belt conveyor 34 is disposed at an level intermediate of the lower end of the closing cover 18 and the base 1 for discharging the molding flask.

The operation of the device mentioned above will now be described. First, in FIG. 1, molding sand 14 is fed by any known device (not shown) into the molding flask 13 and filling frame 13*a* placed on the pattern plate 12. The table 7, which carries the pattern plate 12, molding flask 13, and filling frame 13*a*, is then moved to the right until it reaches the mold-producing area under the air-flow head and press plate assembly 3. FIG. 2 is a side view of the apparatus where the table 7 is stopped under the assembly.

Figure 3:
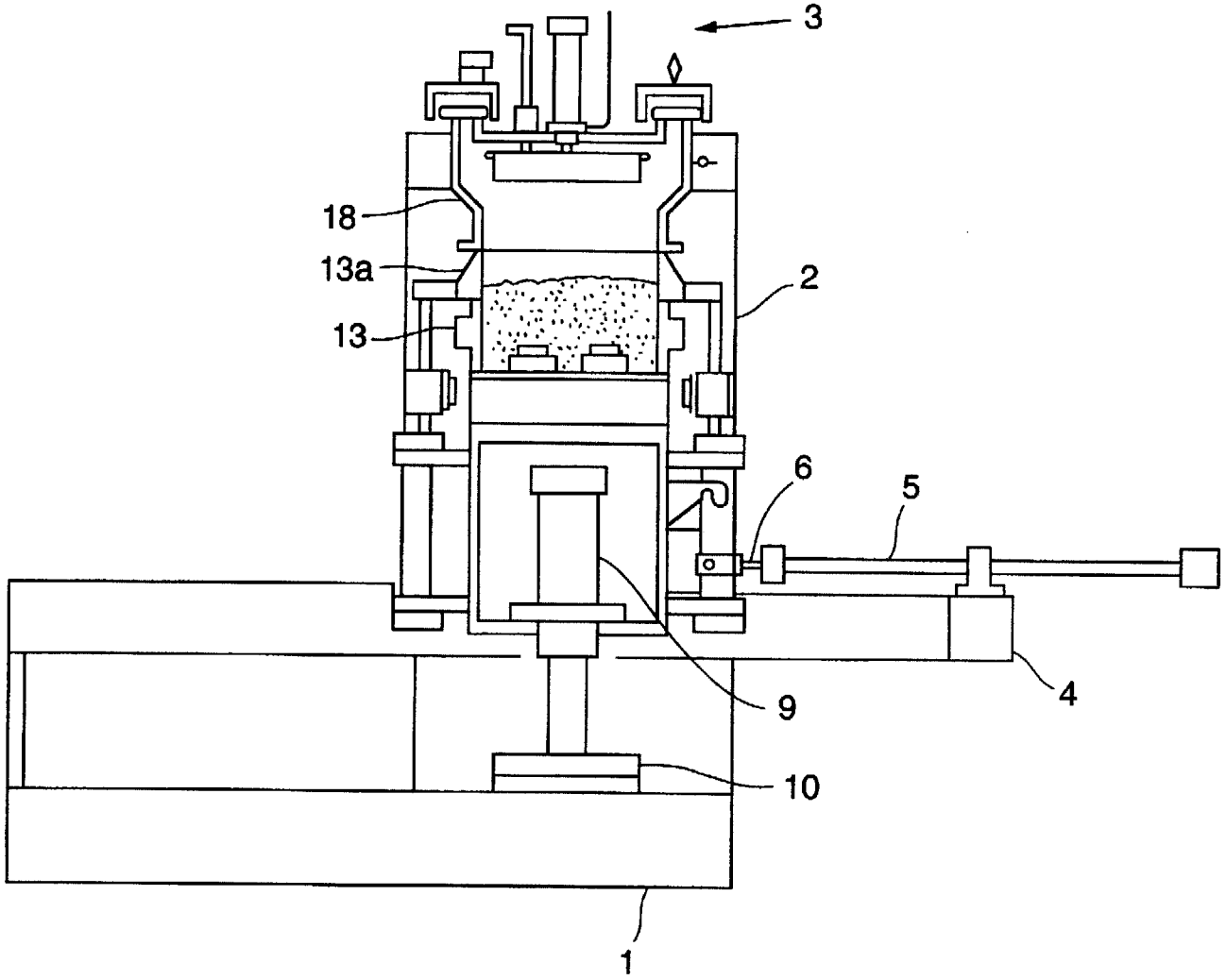
FIG. 3 is a partially cross-sectional schematic view of the embodiment wherein the closed space is just formed.
Figure 4:
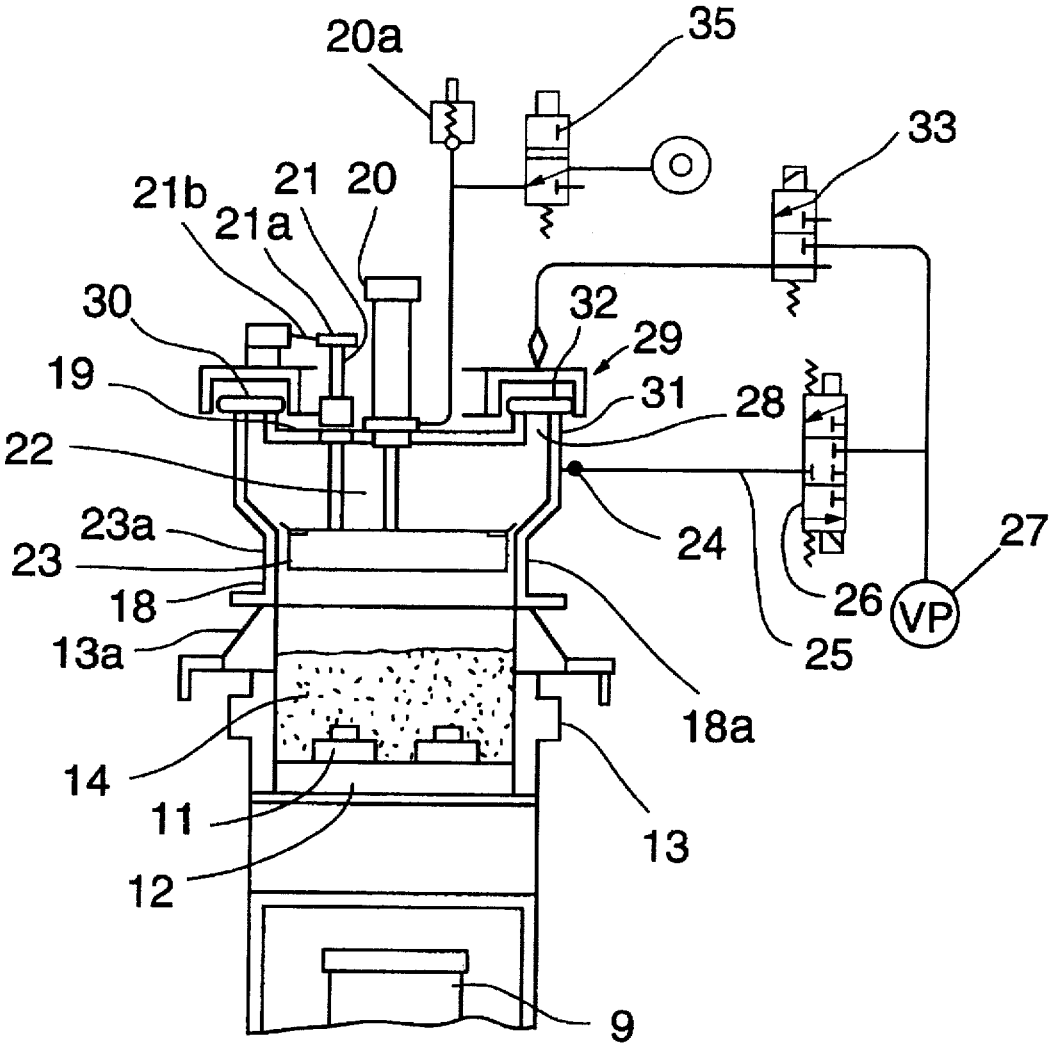
FIG. 4 is a partially cross-sectional schematic view of the embodiment wherein the closed space is separated into upper and lower parts by a press plate.

In FIG. 3 the molding flask 13 and filling frame 13 a are raised by the cylinder 9, which vertically moves the table, until the filling frame 13*a* contacts the bottom of the closing cover 18 to thereby define a closed space. Before the table is raised it is disconnected from the rod 6. An electromagnetic valve 26 is then activated, and air in the closed space, including air existing in the molding sand 14, is evacuated by the vacuum source 27. The electromagnetic valve 26 is deactivated when the closed space reaches a predetermined degree of vacuum. The electromagnetic valve 33 is activated to evacuate the air in the upper space 32 of the piston 30, move the piston 30 up, mad rapidly introduce the ambient air from the lower space 31 of the piston 30 into the closed, space, thereby causing the ambient air flow to pass from the surface of the molding sand 14 through it to the pattern plate 12 to first compact the molding sand. After the first compacting is completed the electromagnetic valve 33 is deactivated to lower the piston 30 to close the air-supply pipe with it. Then, the electromagnetic valve 26 is again activated to evacuate the air in the closed space. When a predetermined degree of vacuum is attained the electromagnetic valve 26 is deactivated, and an electromagnetic valve 35 is activated to lower the press plate 23. When the press plate 23, which is provided with the seal member 23*a*, just enters the small lower part 18*a* of the closing cover 18 (see FIG. 4), the limit switch 21 is activated by the limit switch lever 21*a*, and a signal from the activated limit switch 21*b* activates the electromagnetic valve 33. Thus the piston 30 is again raised to rapidly introduce the ambient air into the closed space via the lower part of the piston 31 and the pipe 28. The difference in pressure between air above and below the press plate 23 causes the press plate 23 to be rapidly pressed towards the upper surface of the molding sand, thereby impinging the molding sand 14 at a high speed and compressing it. During this process the safety valve 20*a* acts to evacuate the air in the cylinder 20 to prevent the pressure inside it from rising so as not to hinder the rapid downward movement of the press plate 23.

When the press plate 23 stops moving down the electromagnetic valve 33 is deactivated to return the press plate 23 to its original position. The cylinder 9, which vertically moves the table, is then lowered to separate the filling frame 13*a* from the closing cover 18, and the cylinder 9 is activated to maintain the level of the rollers 16, 16, equal to that of the conveyor 34, while the table 7 is lowered to support the molding flask 13 by the rollers 16, 16, to separate the molding frame 13*a* from the flask, and to transfer the molding flask 13, as well as the mold produced, onto the conveyor 34.

Because the difference in pressure between the ambient air pressure above the press plate 23 and the vacuum below it is great, because of the weight of the press plate itself as well as the pressure difference, because there is no air below the falling press plate and so there is no resistance of air to it which would hinder its falling, and because there is no air below the falling press plate and so it is not subjected to the upward force of air compressed by the press plate that would occur if the air were to exist under it, the molding sand 14 is compressed rapidly and well.

Although in the embodiment mentioned above an air cylinder is used to suspend the vertically movable press plate in the closing cover, other means, such as an electric cylinder or other mechanical supporting means, may be used.

Figure 7:
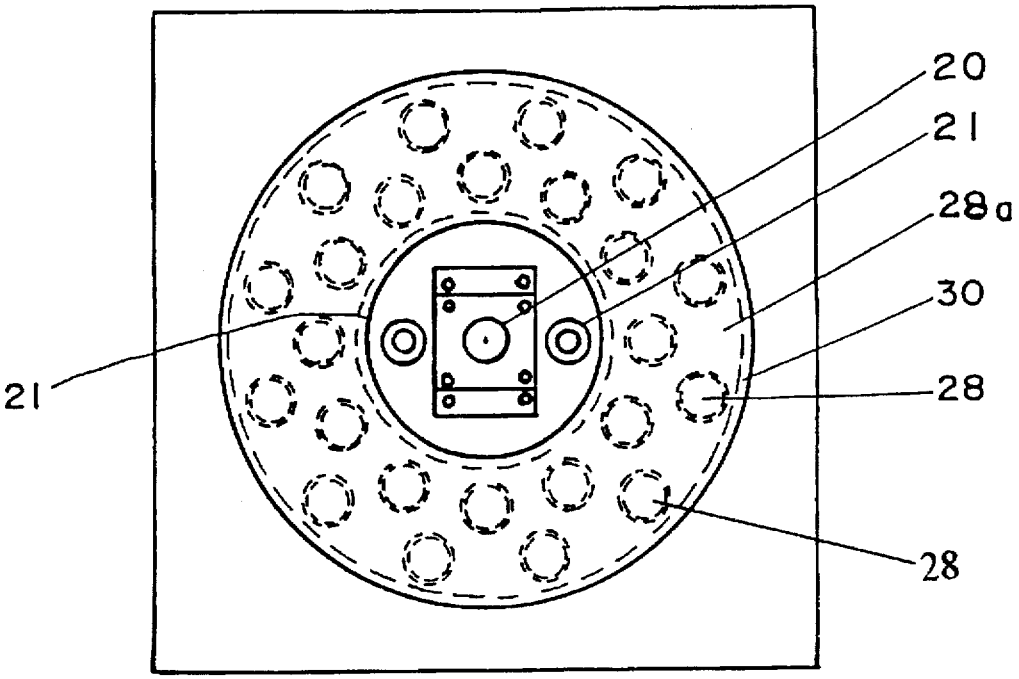
FIG. 7 is a schematic and enlarged plan view of an air-supply pipe and an air valve of another embodiment.
Figure 8:
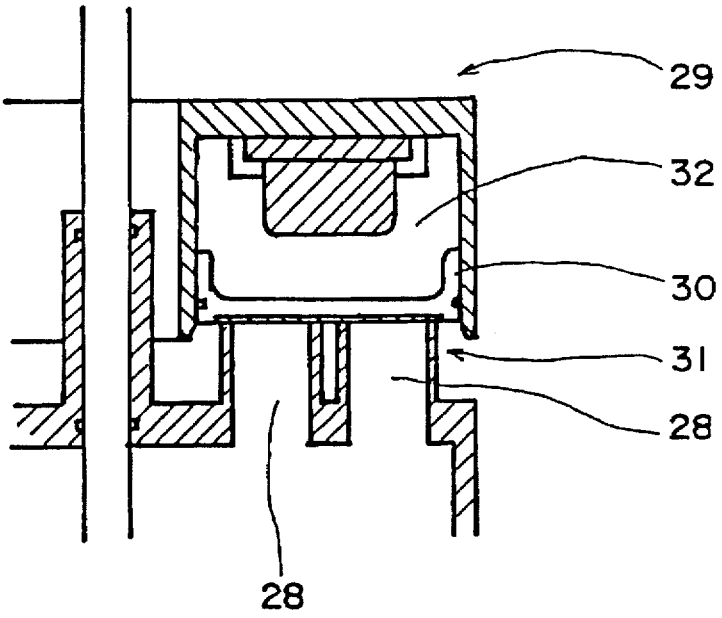
FIG. 8 is a schematic and enlarged sectional view of the air-supply pipe and air valve of FIG. 7.

Further, when the air-supply pipe 28 is annular as in this embodiment, the ambient air introduced into the closed space is not reflected by the press plate 23, thus a suitable and preliminary compression of the molding sand being achieved. That is, when the air-supply pipe 28 is annular as in FIGS. 5 and 6, the air can be introduced between the closing cover 18 and the press plate 23 without itself encountering a large resistance, as is seen from FIG. 3. Further, the one air-supply pipe 28 can be substituted by a plurality of circumferentially arranged circular pipes 28, 28, as in FIG. 7.

The distance (i.e., the height from which the press plate falls) between the upper surface of the molding sand and the bottom of the press plate 23 is at least 30 mm, and preferably 100 mm to 150 mm. To achieve this distance the bottom of the press plate 23 must be 30 mm higher than the lower end of the closing cover 18.

If the distance of the fall is less than 30 mm, the speed of the falling press plate will be slow, and this results in a weak mechanical compression. Experiments show that if the distance of the fall is more than 150 mm the rate of increase in the speed of the press plate in the preliminary compression becomes less, thereby causing a decrease in the mold-producing ability and producing a less-compressed mold. The equation of the falling speed of the press plate for this case is given as follows:

$$\text{the falling speed of the press plate}=\sqrt{2\times(F/m+1)\times 9.8\times h},$$

where

F is the difference in pressure between the air above and below the press plate, m is the mass of the press plate, and h is the height from which the press plate falls.

Further, the unit weight of the press plate 23 must be more than 30 g/cm$^2$, and preferably 100–200 g/cm$^2$. This value is the optimum one in relation to the height from which the press plate falls.

As is clear from the above description, since the apparatus of the present invention uses the difference in pressure between the ambient pressure and a vacuum, it can be of less rigidity and less strength. Further, since the apparatus compresses the molding sand which is in a chamber in which there is no air, the press plate is not subjected to an upward force. These are great advantages to the industrial art.

What we claim is:

1. An apparatus for producing a mold, comprising:

a table movable between an area where molding sand is fed and an area where a mold is produced for carrying a pattern plate on which a flask is mounted;

a cylinder for vertically moving the table;

a closing cover having an opening at the lower part thereof, the opening communicating with an upper opening of the flask, the closing cover having a stepped part such that the cross-sectional area of a lower part of the closing cover is smaller than that of an upper part thereof;

at least one air-supply pipe for communicating with an upper part of the closing cover;

an air valve for communicating with the air-supply pipe to introduce ambient air into the air-supply pipe;

an opening formed in an upper and side part of the closing cover for communicating with a vacuum source; and a press plate suspended in the closing cover for a vertical movement such that the press plate can be airtightly inserted into the small lower part of the closing cover.

2. The apparatus of claim 1 wherein the air valve is in the shape of a ring.

3. The apparatus of claim 1 wherein the air valve includes a plurality of circumferentially arranged openings.

4. The apparatus of claim 1 wherein the spacing between the bottom of the press plate and the closing cover is more than 30 mm.

5. The apparatus of claim 1 wherein the unit weight of the press plate is more than 30 $g/cm^2$.

* * * * *